US012024381B2

(12) United States Patent
Dettori

(10) Patent No.: US 12,024,381 B2
(45) Date of Patent: Jul. 2, 2024

(54) METHOD AND DEVICE FOR STRIPPING A WINDING MANDREL FROM A ROLL

(71) Applicant: MAXIMA S.R.L., Lucca (IT)

(72) Inventor: Daniele Dettori, Capannori (IT)

(73) Assignee: MAXIMA S.R.L. (IT)

( * ) Notice: Subject to any disclaimer, the term of this patent is extended or adjusted under 35 U.S.C. 154(b) by 314 days.

(21) Appl. No.: 17/616,065

(22) PCT Filed: Jun. 4, 2020

(86) PCT No.: PCT/EP2020/065559
§ 371 (c)(1),
(2) Date: Dec. 2, 2021

(87) PCT Pub. No.: WO2020/245319
PCT Pub. Date: Dec. 10, 2020

(65) Prior Publication Data

US 2022/0297967 A1 Sep. 22, 2022

(30) Foreign Application Priority Data

Jun. 5, 2019 (IT) ..... 102019000008130

(51) Int. Cl.
*B65H 75/24* (2006.01)
*B65H 19/22* (2006.01)

(52) U.S. Cl.
CPC ..... *B65H 19/2292* (2013.01); *B65H 2301/418526* (2013.01); *B65H 2406/15* (2013.01)

(58) Field of Classification Search
CPC ..... B65H 75/242; B65H 19/2292; B65H 2301/4185; B65H 2301/41854
See application file for complete search history.

(56) References Cited

U.S. PATENT DOCUMENTS 2,736,507 A * 2/1956 Neese ..... B65H 19/2292 414/781
6,047,916 A * 4/2000 Onnerlov ..... B65H 19/2261 242/534

(Continued)

FOREIGN PATENT DOCUMENTS

EP 0 831 047 A1 3/1998
WO 2005/087639 A2 9/2005

OTHER PUBLICATIONS

International Search Report, Application No. PCT/EP2020/065559, dated Aug. 9, 2020, 3 pages.

(Continued)

*Primary Examiner* — Sang K Kim
(74) *Attorney, Agent, or Firm* — Ware, Fressola, Maguire & Barber LLP

(57) ABSTRACT

A method for stripping a winding mandrel from a roll formed by wrapping a web around the winding mandrel includes the following phases:

to support the formed roll so that an end of the respective winding mandrel is adjacent to a gripping and rotating means for the winding mandrel;

to connect the gripping and rotating means to the end of the winding mandrel and through this means place the winding mandrel in axial rotation; and to apply, by means of a translation means, an axial force to the gripping and rotating means and to the mandrel and, according with the axial force, translate this mandrel by sliding it off the formed roll.

12 Claims, 11 Drawing Sheets

(56) References Cited

U.S. PATENT DOCUMENTS

| | | | | |
|---|---|---|---|---|
| 7,293,736 | B2 † | 11/2007 | Recami | |
| 2013/0333183 | A1 * | 12/2013 | Mazzaccherini .. | B65H 19/2292 29/283 |
| 2014/0084102 | A1 * | 3/2014 | Techlin ..... | B65H 75/2455 242/520 |
| 2016/0214820 | A1 † | 7/2016 | Techlin | |

OTHER PUBLICATIONS

Written Opinion of the International Searching Authority, Application No. PCT/EP2020/065559, dated Aug. 9, 2020, 8 pages.
Communication from EPO pursuant to Article 94(3) EPC dated Jan. 25, 2023 regarding EP application No. 20 729 773.0-1014, citing two new references, 9 pages.

* cited by examiner
† cited by third party

METHOD AND DEVICE FOR STRIPPING A WINDING MANDREL FROM A ROLL

TECHNICAL FIELD

The present invention relates to the technical field concerning the production of rolls of paper, or of other materials, free of a cardboard winding core or the like and refers to a method for stripping a winding mandrel from a roll and a device for stripping the roll winding and forming mandrel from the roll itself.

BACKGROUND ART

There are known machines which are equipped with a shaft (also known as "mandrel" or "mandril" in the sector) for winding, in direct contact, of a paper web a sanitary paper towel, towel, cleaning cloth or the like, smooth, embossed, of various weights and characteristics. Such winding of the web gives rise to a roll (log), assigned for subsequent cutting into the selling pieces, which has no cardboard core which, in addition to be a cost, can be subject to taxation for ecological reasons, increases the weight and does not lend itself to the packaging of flattened rolls to reduce their size.

The rotation of the roll being formed is produced by central mandrils or by axially rotating rollers, parallel to the shaft, supporting this roll being formed. The formation of the roll by means of the rotating rollers rotates the winding mandrel and translates it transversely to itself, upwards, as the diameter of the roll increases.

At the end of the rotation of the roll, that is when the latter is completely formed, the roll winding axis is grasped at one end and extracted axially while a fixed shoulder placed near the same end axially blocks the roll.

A disadvantage of such known method of separating the winding mandrel from the roll consists in the fact that sometimes the axis does not slide into the central coil of the roll which is damaged by the mandrel itself and/or the shoulder. Sometimes the first coil translates with the mandrel making the roll to take a binocular shape that clamps more tightly to the mandrel preventing sliding due to mutual separation and causing damage to the roll, in other cases the extraction force of the winding mandrel deforms the roll into a bellows shape.

A disadvantage of said known machines for making rolls without the cardboard core (also called coreless rollers) consists in the risk of damaging the roll and/or of slowing down or stopping production due to the removal of the roll stuck to the winding mandrel.

There are also known machines forming rolls around a winding mandrel consisting of an axially elastic material in which the diameter is varied so as to facilitate its extraction, favouring detachment from the first paper coil at the time of the axial extraction of the roll winding axis.

A disadvantage of these latter known machines consists in the fact that the rolls made with very compact windings (as in the case of industrial rolls) require very intense forces for the extraction of the mandrel which can damage such mandrel.

Another disadvantage of these known machines consists in the fact that they are very complex, for example they provide a gripper for each end of the mandrel, and they provide a highly articulated operating cycle which extends the cycle times.

DISCLOSURE OF THE INVENTION

An object of the present invention is to propose a method for stripping a winding mandrel from a roll by reducing the axial extraction force and eliminating or reducing the risks of damaging the roll or parts of the device.

Another object is to propose a device for extracting a roll winding and forming mandrel from the roll itself without damaging it and without excessively stressing parts and components of the device itself.

Further objects are to propose a relatively simple method and device, that is, with a reduced number of phases or parts and elements.

Other objects are to propose a method and a device capable of removing the mandrel quickly and virtually free from the risk of blocking the device.

A further object is to propose a device provided with a winding mandrel, also metallic, resistant, inexpensive and easy to clean with chemical and even physical means.

Another object is to propose a device capable of eliminating or reducing traces of glue from the winding mandrel during the extraction phases.

A further object is to propose a method and elements capable of facilitating extraction both in the device of the present invention and in stripping devices of a known type.

Document EP1725485 A2 discloses a method for stripping a winding mandrel from a roll formed by wrapping a web around said winding mandrel. Said method comprises the phase of supporting the formed roll. Said prior art document further discloses a device for stripping, according to the above reported method, a winding mandrel from a formed roll made by winding a web around such winding mandrel that has two ends, first and second protruding from this formed roll; said device comprises a support element assigned to support the formed roll and a gripping means assigned to removably connect the first end of the winding mandrel of the formed roll supported by the support element; moreover, document EP1725485 A2 discloses a device for facilitating the extraction of a winding mandrel from a roll formed by winding around such winding mandrel having two ends, first and second protruding from this formed roll, said facilitating device comprising at least a support element assigned to support the formed roll, a gripping means assigned to removably connect to the first end of the winding mandrel of the formed roll supported by the support element, and a motorized translation means connected at least to the gripping means to translate it parallel to said longitudinal axis of the winding mandrel of the formed roll supported by the support element.

The quality and efficiency of the extraction of the winding mandrel from the roll are related to the amount of extraction force required. The higher is this force, the higher is the risk that the extraction will produce one or more damages and/or blockages and/or failures.

The object of the present invention refers to a method and a device for reducing the extraction force of a mandrel winding and forming a coreless log roll from the roll itself, eliminating or reducing said risks.

The method involves the phase of rotating the winding mandrel before or starting from the beginning of its extraction from the roll.

The friction force generated between the winding mandrel surface and the first paper coil is at least approximately proportional to the pressure generated by the winding of the paper on the mandril and to the friction coefficient and is directed according to the direction of the relative speed slip between the paper and the surface of such mandrel; by applying a relative rotation speed between paper and mandril while extraction is also performed, two speed components are added, one axial, and one transversal, i.e. perpendicular to the extraction direction. The resulting speed will therefore have a direction inclined by an angle (a) with respect to the axial direction and therefore the frictional force in that direction will be multiplied by a factor cos (a)<1.

The tests and trials conducted, during which the stripping force was measured directly by means of load cells interposed between actuators and elements driven by them and indirectly by measuring the current absorbed by the electric motors of the actuators have shown, other conditions being equal, that surprisingly the extraction force from the roll of the winding mandrel placed in rotation was 15% to over 55% lower than the force required in the absence of rotation.

It was also found that the direction of the winding mandrel rotation opposite the winding direction of the roll allows to reduce the extraction force compared to that required with the opposite direction of the mandrel rotation.

At least in the verified cases, even short cycles of repeated inversion of the rotation direction of the shaft prior to its extraction were advantageous.

The solutions for obtaining the method of the invention can be many. The simplest is to apply a sufficient rotation torque to the extraction end of the winding mandrel by means of a vice capable of clamping the end of the mandrel itself or a terminal element specifically attached to said end, where this vice also transmits the extraction axial force to the mandrel together with the extraction movement.

In this case the maximum applicable torque is limited to the force that can be transmitted to the end by means of the vice, and furthermore the possibility of relative slips between the winding mandrel and the vice could not be excluded, with the risk of losing control over the rotation speed.

The safest and most efficient system for transmitting a rotation torque is by means of two surfaces orthogonal to the forces acting on them, then by means of geometric coupling, for example of the type that is created between two gear teeth, or between a key and the shoulders of its seats and not by friction as occurs, for example in clutches or vices.

To do this, however, there must be an angular "phase" or "synchronization" between a face or surface of the end of the winding mandrel and a corresponding one on the extraction mechanism so that they can exchange a force; however at the time of extraction the winding mandrel is always in a random angular position.

The invention therefore includes also an innovative mechanism to ensure simultaneous extraction and rotation by means of a geometric coupling. This extraction mechanism of the invention provides that the winding mandrel carries at its extraction end a mushroom-shaped terminal element whose chapel, which protrudes from the mandrel, is equipped with at least two facets parallel to the mandrel axis and assigned to transmit a torque. The surface of the chapel opposite the mandrel is rounded or flat and perpendicular to the mandrel axis. The terminal element takes an overall approximate "T" shape with the upper section of the "T" delimited by the two facets.

The extraction mechanism also includes a head rotating on a bearing suitable to carry on also an axial load and fixed to a carriage that can move parallel to the axis of rotation of the head and the winding mandrel. At least when the roll is complete and it is necessary to proceed with the extraction of the mandrel, said head is aligned with the mandrel itself and the rotation axis and the mandrel axis coincide.

The head is driven in rotation by an actuator or rotary servomotor and the carriage is translated in a direction parallel to the mandrel axis by a servomotor or linear actuator for the extraction of the winding mandrel from the roll.

Therefore, in the extraction condition or phase, said head can rotate around the axis of the mandrel to be extracted and can translate along such axis.

The head is equipped with a concave attachment for the terminal element and equipped with a grooved profile that allows it to slide with respect to the carriage along the respective rotation axis; this attachment is kept elastically protruding towards the terminal element by an elastic element such as a compressed helical spring of the head.

The attachment is equipped with at least two shaped grooves each having a first axial section and a second section perpendicular to the first and directed in the opposite direction to the head rotation. The first axial sections of the two shaped grooves are connected by the internal cavity of the concave attachment and can be obtained, starting from the internal surface of the attachment, in part of the thickness of the attachment wall or, and as showed, through the entire thickness of said wall. Such grooves are assigned to house the portion of the terminal element between the two facets, in other words each protruding side portion of the upper or transversal section of the "T" terminal element can slide and be housed in a respective groove of the attachment. Therefore, the terminal element and the attachment form a bayonet attachment type connection.

The portion of the device close to the end of the roll on the side of the head and of the carriage has a fixed shoulder element, for example a disc shape with a central hole for the passage of the mandrel; this shoulder element is assigned to match with the corresponding end of the roll preventing the latter from translating axially during the stripping of its mandrel.

The device portion opposite the carriage includes a fixed stop assigned to match with the winding mandrel end opposite the terminal element and assigned to avoid the further axial translation of such mandrel beyond its position of winding the roll. Alternatively, such stop can be mobile and driven by a cylinder which brings it to a position close to the contrast, and then move it and leave room for movement to the cradle or conveyor of the support element 3 to allow the entry of a new log.

When the roll is fully wrapped and complete, the carriage moves the head in the terminal element direction until it matches with the head attachment; if the protruding side portions, between the two facets, of the terminal element face the axial sections of the grooves then these protruding side portions slide to the bottom of the axial sections of the grooves; if, as generally happens, the protruding side portions of the terminal element are not facing the groove, then the translation of the carriage following the matching between the terminal element and the attachment causes the attachment to stop and the compression of the respective spring, a subsequent rotation of the head and the attachment will bring the protruding portions of the terminal element first in correspondence with the grooves and then, due to the effect of the spring, the sliding of such protruding portions to the bottom of the axial sections of the grooves.

A further rotation equal to at least the angular extension of the second sections of the grooves completes the coupling.

It is therefore possible to guarantee the coupling by carrying out the following sequence of operations following the alignment of the longitudinal and rotation axis of the winding mandrel and the head respectively:

translation of the carriage and the head in the direction of the mandrel by a space greater than or at least equal to the length of the axial sections of the grooves of the attachment;

carrying out a first rotation of at least 180° of the head and the attachment ensuring the insertion of the terminal element into the attachment;

starting the rotation of the head ensuring the coupling or the radial and also axial coupling of the head to the winding mandrel terminal element and simultaneous or subsequent start of the translation of the carriage and of the consequent stripping of the winding mandrel keeping the latter in rotation.

Preferably the rotation occurs in the opposite direction of the roll winding one. It is also possible to carry out short rotations in alternating directions of rotation before stripping the mandrel.

As an alternative to the phase of actuating a first rotation of at least 180° of the head and the attachment, the invention provides for orienting the angular position of the winding mandrel or mandril of the roll or log and obviously of the respective terminal element upstream of the device, that is before the roll is facing the head, so that when the "T" end of the mandril, that is the terminal element, faces the corresponding gripping means of the bayonet attachment they are already correctly oriented angularly and in phase for their mutual engagement and coupling by means of the translation and subsequent rotation of the gripping means and therefore without preliminary need for said first rotation.

The invention also provides for optional presses or jaws placed tangentially to the roll and actuated, if necessary, to match such roll preventing its rotation due to dragging by the rotating mandrel around which it is wound.

The device can therefore apply a rotation speed and at the same time an extraction speed to the winding mandrel. The extraction force will be supported by the shoulder element which therefore can also produce a contrasting torque due to the friction on the rotation torque so that the roll itself does not rotate integrally with the winding mandrel. It will be possible to apply a rotation to the winding mandrel (without rotating the whole roll) only if an axial extraction movement is applied at the same time or it is necessary to calibrate the speeds and times taking into account the roll inertia or the optional presses or jaws for locking the roll will be adopted.

The invention also provides that the device may include an optional annular element integral with the attachment, associated with a proximity sensor that detects its position when the attachment is in the "engagement" position, that is with the spring at maximum extension.

When, on the other hand, the spring is compressed due to the lack of alignment of the terminal element protrusions with the grooves of the attachment during the advancement of the carriage towards the mandrel, the sensor does not detect the annular element, generating a signal relating to the incorrect position of the attachment for engagement.

At this point, a programmed device control system controls a slow rotation of the rotating head by correctly positioning the attachment with respect to the terminal element allowing the spring to push the attachment by engaging the terminal element, the sensor consequently gives the signal that the rotation and the translation of the extraction cycle can be started.

The invention also provides for the possibility of adopting, in association with the device of the invention or with devices of the known type, a device for blowing gas, preferably air through a cavity and through holes of the winding mandrel to create a gaseous bearing between the mandrel and the roll able to reduce friction and facilitate the extraction of the mandrel from the roll.

BRIEF DESCRIPTION OF DRAWINGS

The characteristics of the invention are highlighted below with particular reference to the accompanying drawings in which.

DETAILED DESCRIPTION OF EMBODIMENTS OF THE INVENTION

Figure 1:
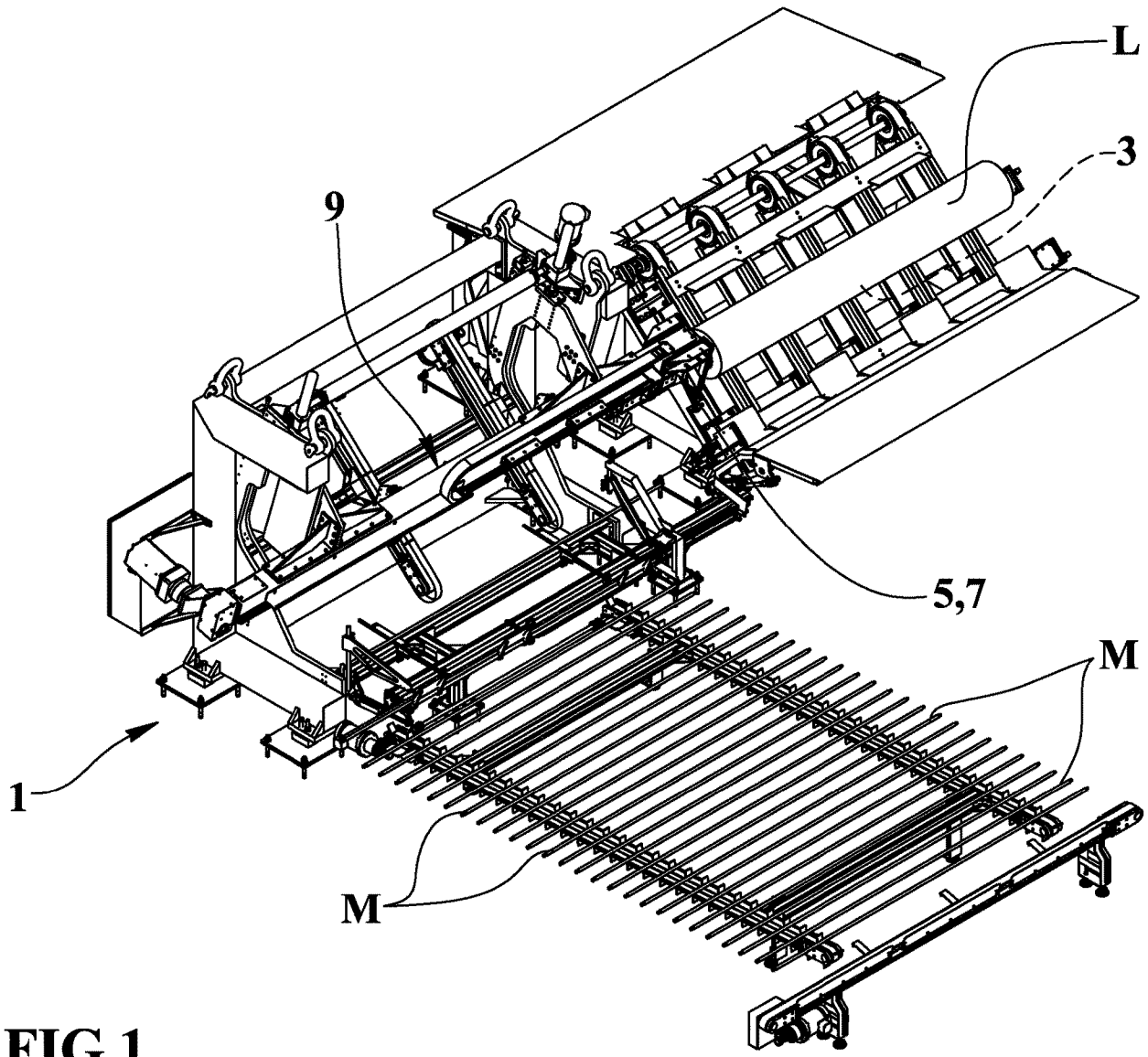
FIG. 1 shows an isometric and schematic view of the device for stripping a winding mandrel from a roll, object of the present invention, in a condition immediately preceding the stripping of a winding mandrel from a roll formed around such mandrel.
Figure 2:
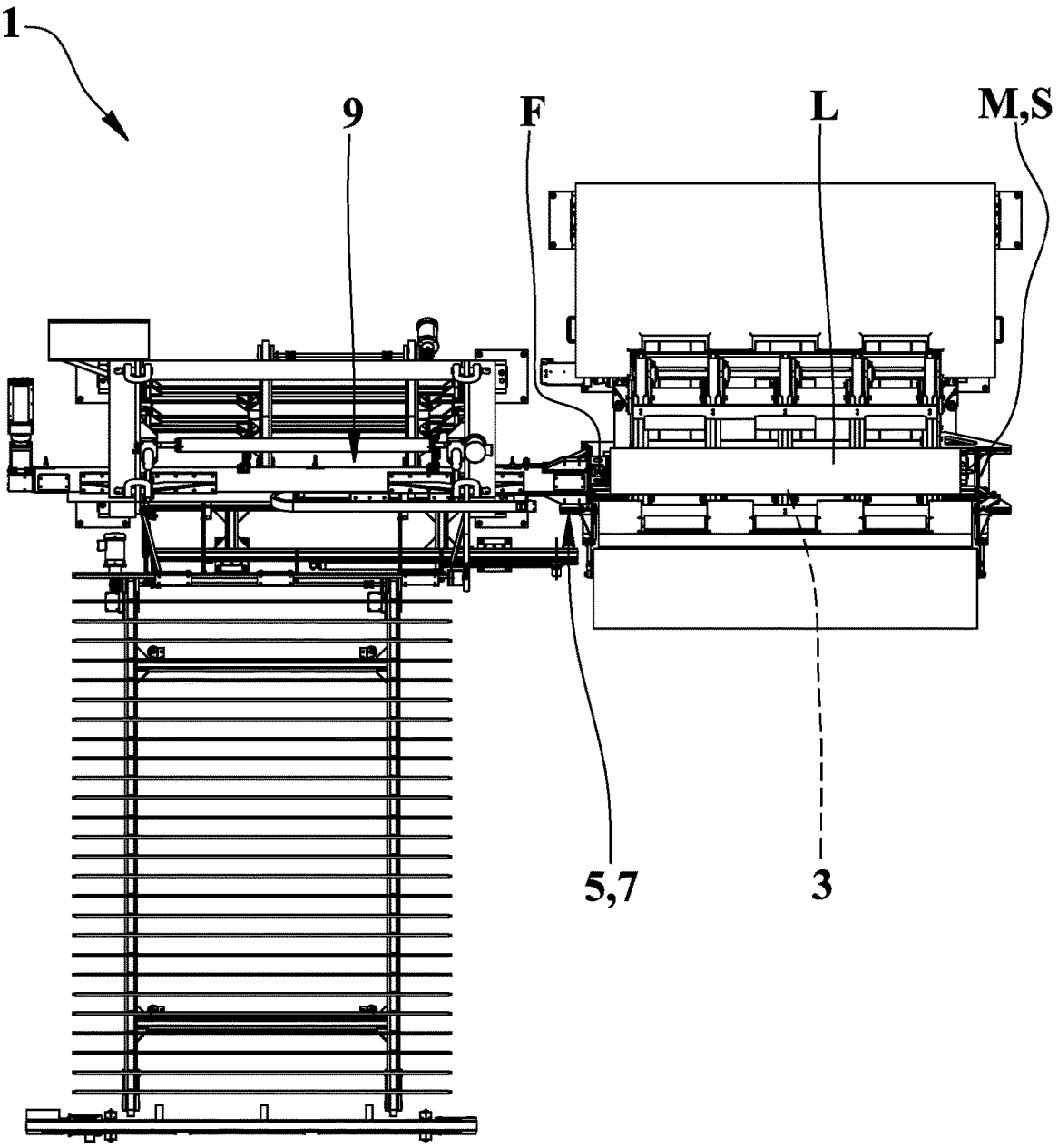
FIG. 2 shows an orthogonal projection view from above of the device of FIG. 1.
Figure 3:
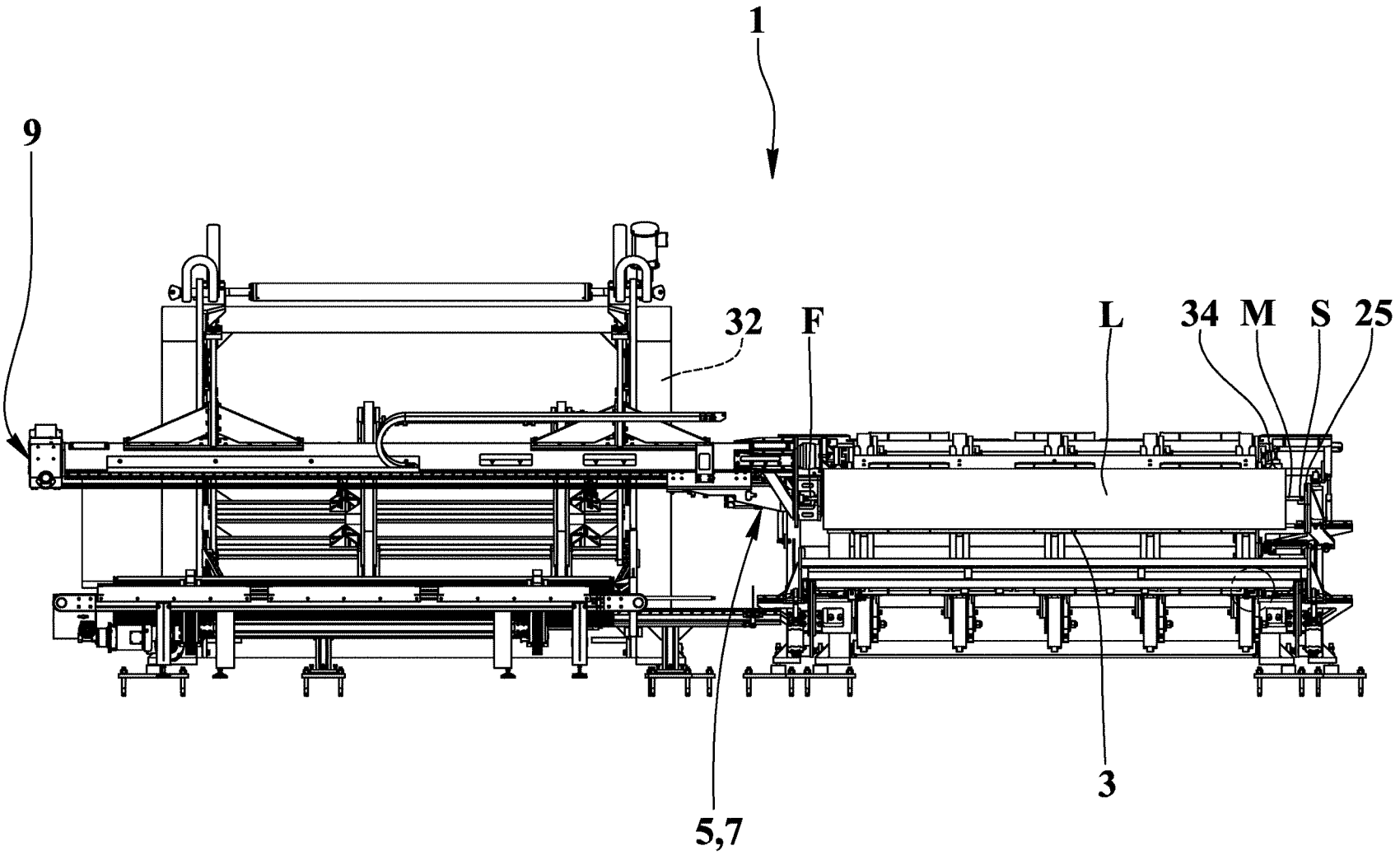
FIG. 3 shows a front view of the device of FIG. 1.
Figure 4:
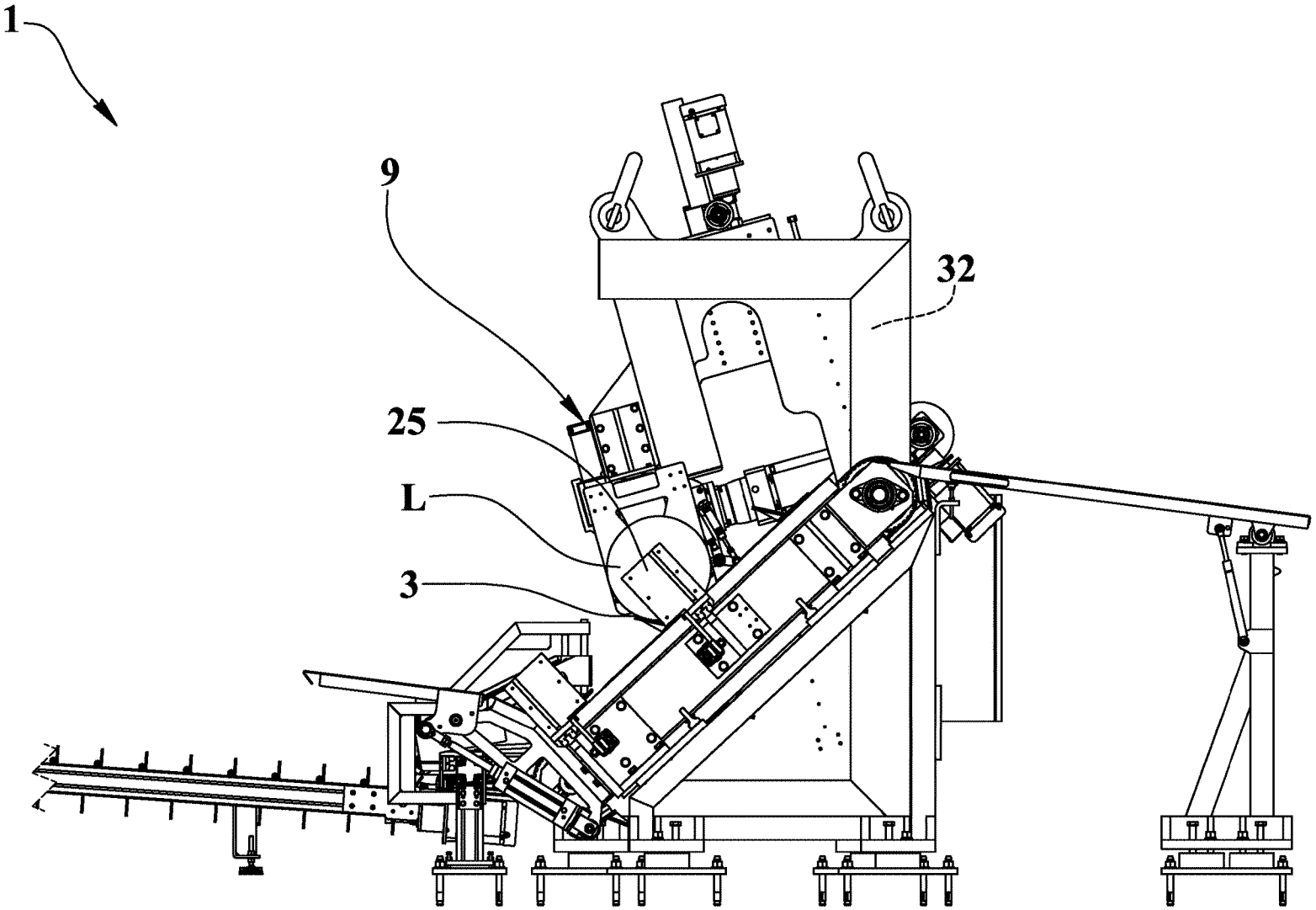
FIG. 4 shows a side view of the device of FIG. 1.
Figure 5:
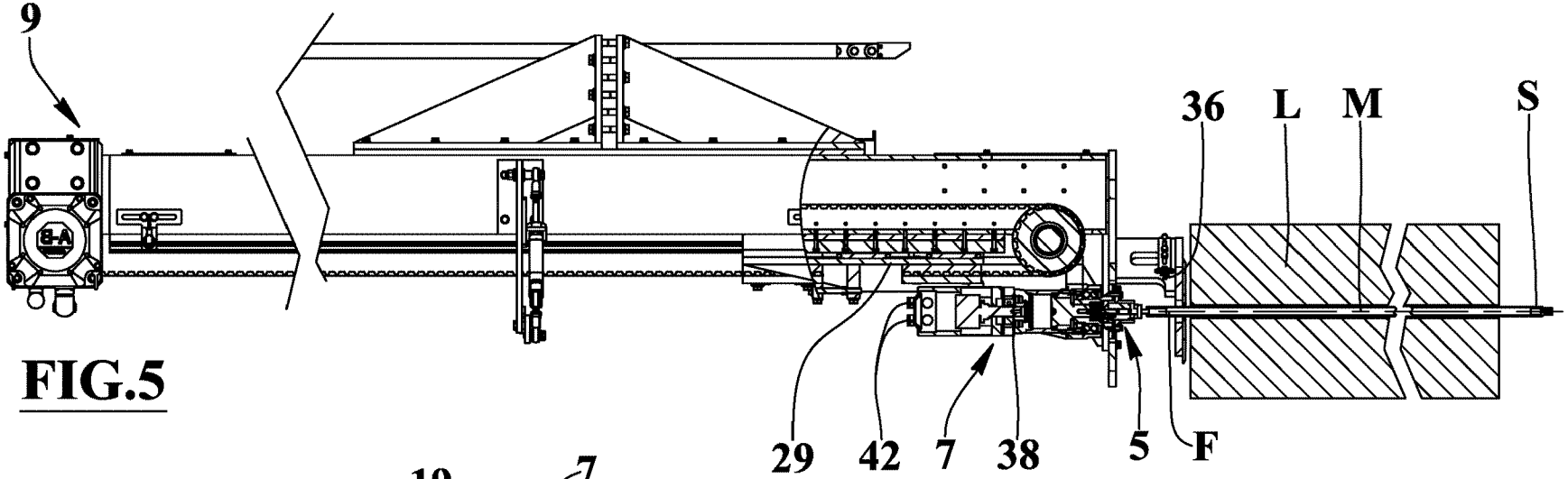
FIG. 5 shows an incomplete and partially sectioned view of a detail of FIG. 3 in an initial phase of coupling of a mandrel terminal element to an attachment of a mandrel gripping means.
Figure 7:
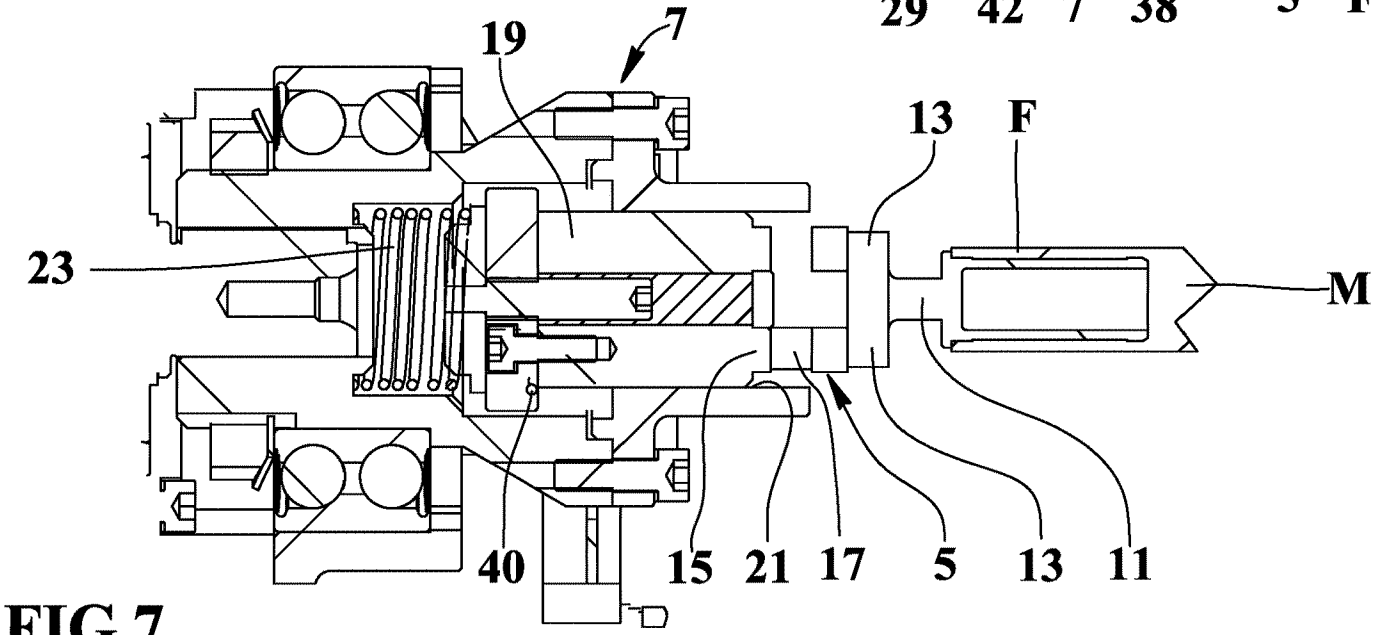
FIG. 7 shows an enlargement of a portion of FIG. 5.
Figure 6:
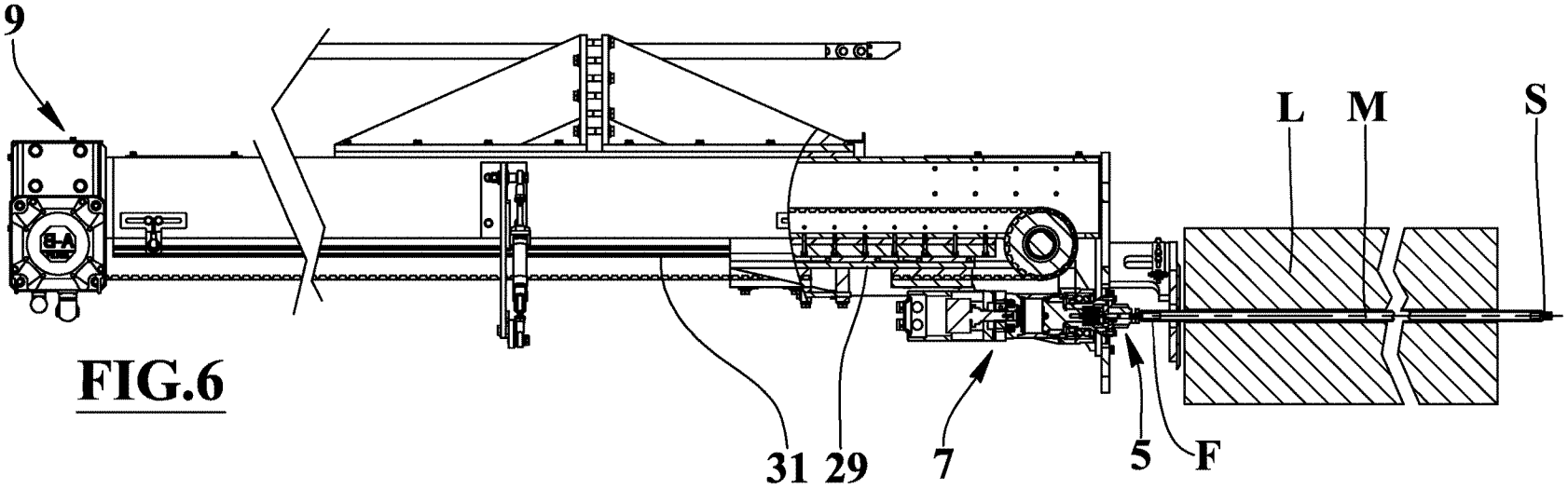
FIG. 6 shows an incomplete and partially sectioned view of a detail of FIG. 3 in a coupling condition of a mandrel terminal element to an attachment of a mandrel gripping means.
Figure 8:
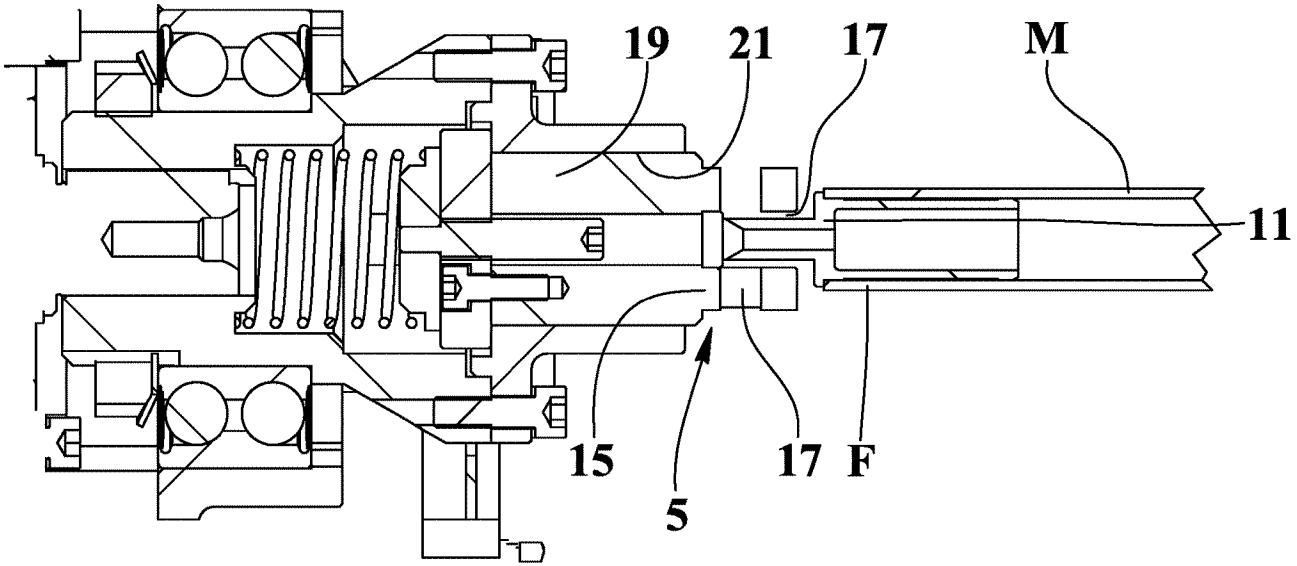
FIG. 8 shows an enlargement of a portion of FIG. 6.
Figure 10:
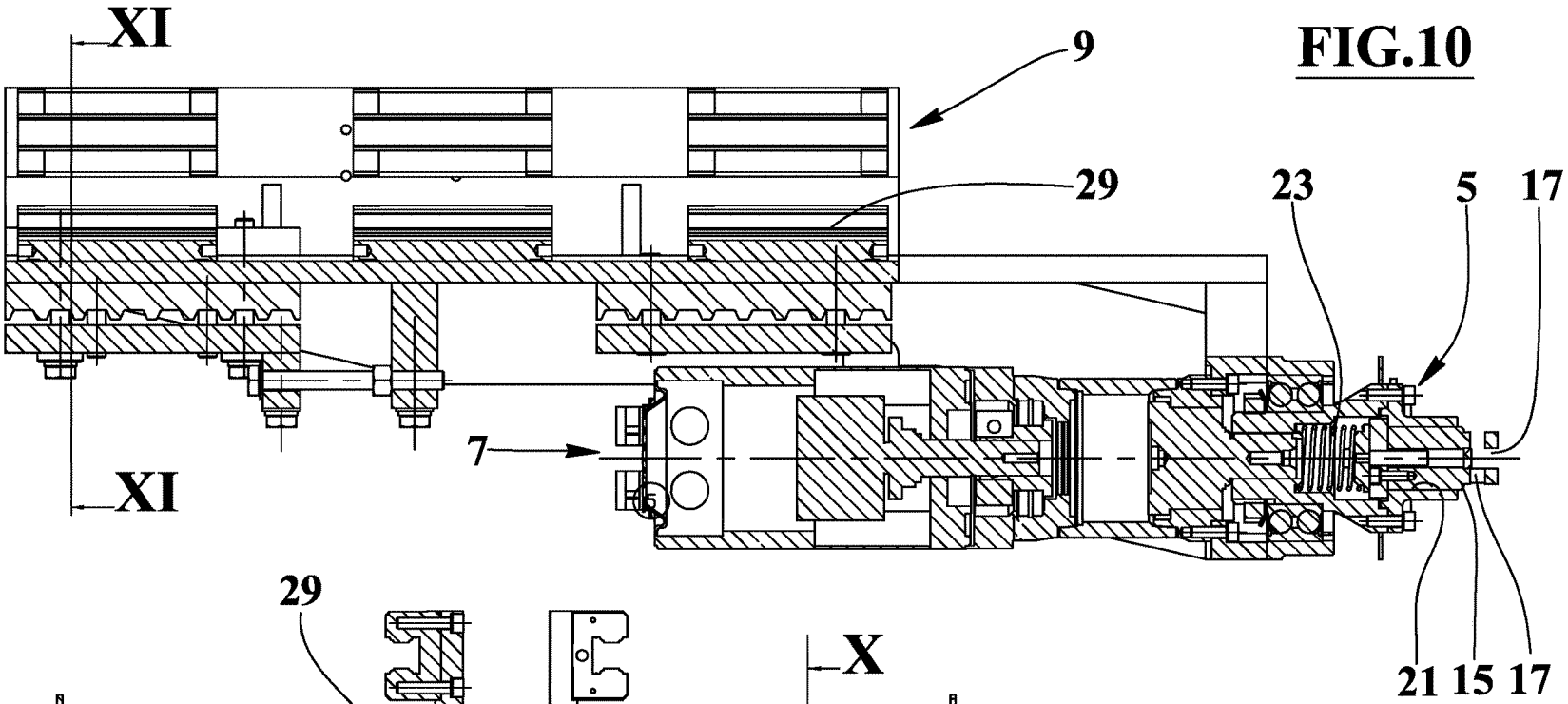
FIG. 10 shows a section view according to the X-X plane of FIG. 9.
Figure 9:
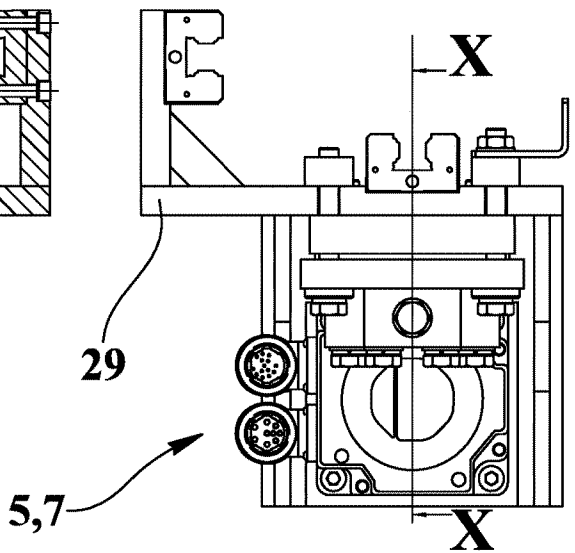
FIG. 9 shows an enlarged side view of a portion of FIG. 1 in which some parts have been removed.
Figure 11:
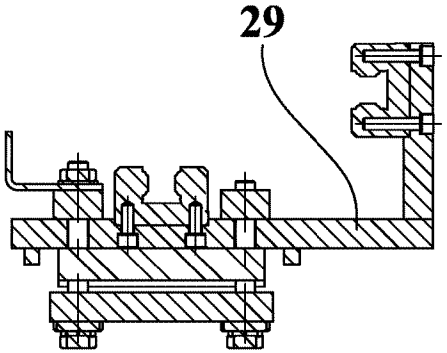
FIG. 11 shows a section view according to the XI-XI plane of FIG. 10.
Figure 12:
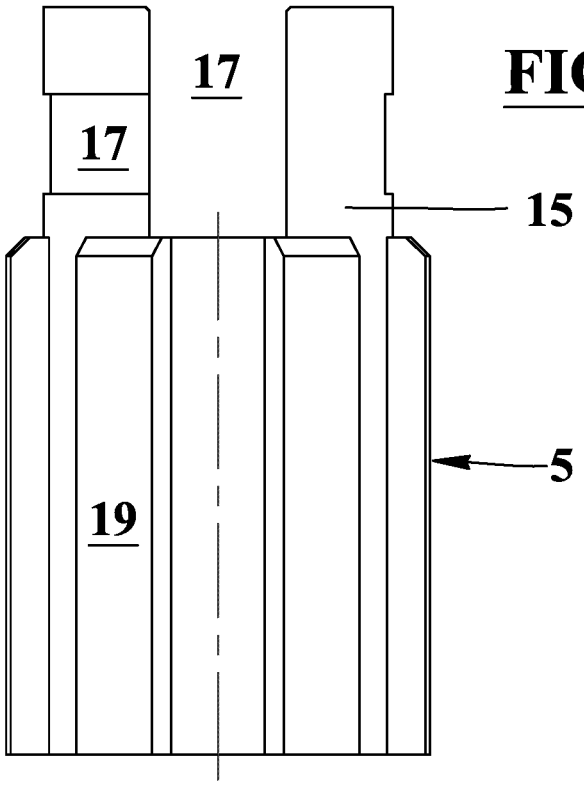
FIG. 12-15 show front and isometric views, from different points of view, of an attachment clearly visible in FIGS. 5-8.
Figure 13:
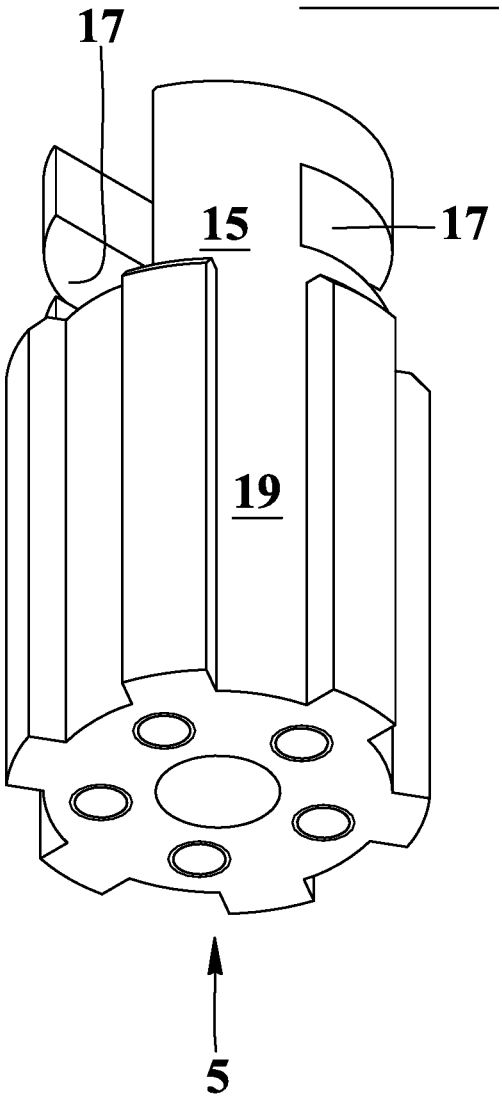
Figure 14:
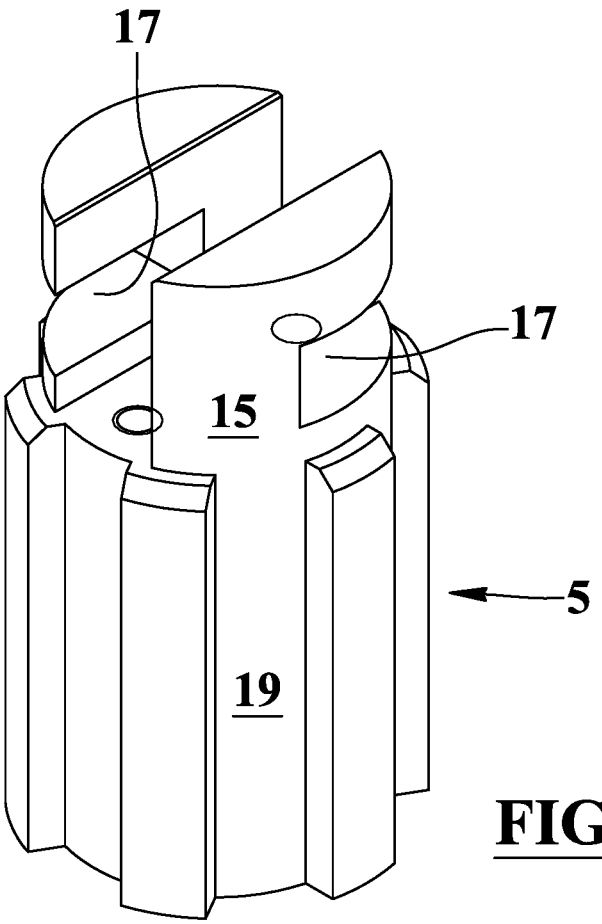

The present invention relates to the extraction or stripping of a mandrel or core (hereinafter sometimes referred to only as "mandrel") from a roll that was formed by winding a web around such mandrel. The extraction, separating the roll from the mandrel, gives rise to a coreless type roll, that is of the type called "coreless log", and makes the mandrel or core free for a new winding cycle.

The web can be made of plastic material, fabric, non-woven fabric and practically of any flexible thin material and the present discussion refers, in a particular but not exclusive way, to paper webs, for example kitchen or sanitary type and kitchen or toilet coreless paper rolls.

The method, object of the present invention, is required to extract, without the drawbacks of the known methods, a winding mandrel from a roll formed by winding a web which, as seen, can be for example of kitchen or sanitary paper, rolled up around such winding mandrel.

The web, wrapping with an initial direct contact with the mandrel, forms a roll without a tubular core that is consists of a coreless roll.

At the end of the roll forming, the ends of the mandrel protrude from the roll itself and said mandrel must be removed to allow the subsequent phase of cutting the roll to obtain the pieces ready for use or for subsequent processing.

Such method involves the following phases:

- to support the formed roll by placing one end of the respective winding mandrel adjacent to a gripping and rotating means of the winding mandrel;
- to connect the gripping and rotating means to the end of the mandrel and by means of this means put the winding mandrel in axial rotation;
- to apply, by means of a translation means, an axial force to the gripping and rotating means and to the mandrel and translate, in accordance with the axial force, such mandrel by sliding it off the formed roll;
- at the end of the exit stroke of the mandrel from the roll, to disengage the gripping means from the mandrel by releasing the latter and making it available for a further winding cycle.

In the previous and following text the terms "axial rotation" or "rotation" referring to the winding mandrel (preferably of an elongated cylindrical shape) indicate a rotation of the latter around its own longitudinal geometric axis and the term "translation" means a linear movement of the mandrel along its longitudinal geometric axis.

The formed roll can be positioned manually, for example by depositing it on a special support cradle, or automatically by means of a conveyor that carries it and supports it in the mandrel stripping position. In both cases, positioning allows to place one end of the respective winding mandrel adjacent to a gripping means or within the action range of the latter. The method involves the use of a vice or geometric coupling type device between the means itself and the suitably shaped end of the winding mandrel. In the case of geometric coupling between the gripping means and the shaped end of the winding mandrel, the method involves positioning the roll and the mandrel so that the longitudinal axis of the mandrel and of the gripping means coincide or almost coincide and that the end of the mandrel faces the gripping means and placed at a distance from the latter less than a predetermined threshold.

The method also includes at least one of the phases of:

- starting the winding mandrel rotation before the axial translation of the mandrel itself or simultaneously with the start of such axial translation;
- putting the winding mandrel in axial rotation, during the axial translation of the mandrel, in a rotation direction opposite to that of the roll winding;
- carrying on, by means of the gripping and rotating means, a rotation fraction or one or more rotations of the winding mandrel in the same winding direction of the roll before starting the axial rotation in the rotation direction opposite to that of roll winding and said translation of the winding mandrel;
- carrying on, by means of the gripping and rotating means, a set of axial rotations of the winding mandrel in the two alternate winding directions of the roll before starting the axial rotation in the rotation direction opposite to that of roll winding and said translation of the winding mandrel;
- blocking the roll, using presses or jaws, at least during the phases of rotation of the winding mandrel.

Such method can be applied to the production of coreless rolls of any material as well as paper.

The trials and tests carried out during the stripping of the mandrel from the sanitary and kitchen paper roll showed a surprising reduction in the dynamic friction and the axial force necessary for the stripping of the rotating mandrel, as required by the method, compared to the stripping performed without rotation. It is perhaps presumable that, following the rotation, different and/or additional speeds will be introduced at the mandrel-roll interface with respect to that of simple and pure sliding friction.

The method also provides the optional and possible phase of blowing air or other gas between the roll and the mandrel through through holes and a longitudinal cavity of said mandrel during rotation and stripping of the latter or during a known type extraction performed by the only translation of the mandrel.

Referring now also to FIGS. 1-21, numeral 1 indicates the device, object of the present invention, for extracting, also according to the method described above, a winding mandrel from a roll formed by winding around such mandrel.

Such device 1 is assigned to extract or strip out a winding mandrel, for example an elongated cylindrical mandrel made of metal or preferably of a composite such as carbon fiber in an epoxy matrix or other synthetic materials, from a formed roll L for winding around such winding mandrel M of a sheet or web of thin flexible material such as, for example but not limited to, paper, toilet paper, kitchen paper or absorbent paper or other fibrous and non-fibrous materials. The winding mandrel M has two ends, first F and second S protruding from the formed roll L.

Device 1 comprises:

- a support element 3 assigned to support the formed roll L;
- a gripping means 5 assigned to connect removably to the first end F of the winding mandrel M of the formed roll L supported by the support element 3;
- a motorized rotation means 7 connected to the gripping means 5 to rotate it around its own rotation axis coinciding with the longitudinal axis of the winding mandrel M of the formed roll L supported by the support element 3;
- a motorized translation means 9 connected to the rotation means 7 to translate it parallel to said longitudinal axis of the winding mandrel M of the formed roll L supported by the support element 3.

The support element 3 can consist of a cradle, a fixed seat or housing or, preferably, a porter conveyor of the type called "cleated belt" where the volume between one face of each porter or protruding arm and one face of the belt o chains acts as a housing for a respective roll with the corresponding mandrel M, also referred to as "mandrel". Alternatively, the conveyor can be of the pocket or bucket type or of another type. Regardless of its nature, the support element 3 of the conveyor fixes or positions the roll so that its first end F is within the action range of the gripping means 5.

The latter gripping means can be of the friction type, for example consisting of a vice with clamping jaws of the first end F of the winding mandrel M, or of the type with geometric coupling, in both cases capable of grasping said end to transmit axial forces and axial rotation torques to the mandrel and able to release the mandrel end.

Each rotation and translation means is capable of independently transmitting to the gripping means, and to the mandrel grasped by the latter, forces and motions respectively of rotation around the longitudinal geometric axis of the mandrel and of translation along such geometric axis longitudinal mandrel.

In a condition in which the first end F of the winding mandrel M of the formed roll L supported by the support element 3 faces the gripping means 5, the actuation of the latter causes its connection to the first end F of the winding mandrel M, the actuation of the rotation means 7 places the gripping means 5 and the winding mandrel M in rotation around the longitudinal axis of such mandrel and the simultaneous or subsequent actuation of the translation means 9 translates at least the gripping means 5 and the winding mandrel M parallelly to the longitudinal axis of the latter mandrel M by sliding it off the formed roll L.

Preferably the gripping means 5 is of the type with removable geometric coupling with the first end F of the mandrel suitably shaped.

Such removable geometric coupling, particularly the bayonet one, is preferable to said coupling by friction since it guarantees the transmission of greater forces and torques.

In order to achieve the removable geometric coupling, of the bayonet type, the first end F is equipped with a terminal element 11 rigidly fixed to the winding mandrel M. The free end of the terminal element 11 has at least one radial protrusion 13 and one end of the gripping means 5 comprises an attachment 15 with at least one L-shaped slot 17 where a section of the "L" is parallel to the longitudinal geometric axis of the attachment and the other section is perpendicular to the first section. The section parallel to said geometric axis has an open end towards the mandrel for the insertion of the respective protrusion forming a removable fixing between the gripping means and the bayonet type winding mandrel.

By way of example, the terminal element 11 can be made of metallic or composite material and includes a cylindrical portion, assigned to be blocked in a longitudinal cavity of the mandrel up to its stop collar against the first end of the mandrel itself. The end of the cylindrical portion equipped with the collar has a thinned shank aligned with such cylindrical portion whose collar opposite end has a prismatic element protruding laterally and symmetrical with respect to the longitudinal geometric axis of the cylindrical element and the shank. The two side ends of the prismatic element constitute the two radial protrusions 13 of the terminal element.

By way of example, the gripping means 5, made for example in a single body of metal or composite material, is symmetrical with respect to its own longitudinal geometric axis and is equipped with a longitudinal through cavity. The attachment 15 of the gripping means 5 comprises two parts, fixed to the coupling element 19, each sector-shaped of a cylinder coaxial to the gripping means 5 and separated by an empty space in the shape of a parallelepiped having four sides parallel to the longitudinal geometric axis of the gripping means 5 and one bottom side and the opposite side perpendicular to such axis. Each of the two parts of the attachment has a groove perpendicular to the longitudinal geometric axis of the gripping means 5 which extends starting from an edge of the respective part and extends beyond half of said part. Each of said grooves, together with the space between the two parts, constitutes one of the L-shaped slots 17.

Obviously, the space between the two parts is sized for the sliding of the prismatic element of the terminal element 11 and the perpendicular grooves of the two parts are sized for the sliding of the two radial protrusions 13 constituted by the ends protruding radially from the shank of the prismatic element.

The back wall of the prismatic space that separates the two parts of the attachment 15 has threaded holes for screw fixing of a stop element, for example of plastic or other resilient material. The face of the stop element opposite to the coupling element 19 is aligned or slightly more external than the back faces of the perpendicular grooves of the two parts.

The stop element, in addition to dampening the matching of the prismatic element with the bottom of the prismatic space, facilitates the entry of the two radial protrusions 13 into the portions of the L-shaped slots 17 perpendicular to said longitudinal geometric axis.

The coupling element 19 is in the shape of a grooved mandrel to slide in the complementary seat element 21 of the rotation means 7. The length of the seat element 21 is equal to or greater than the length of the faces of the prismatic space parallel to said longitudinal axis subtracted from the thickness of the stop element.

The face of the coupling element 19 opposite of the attachment 15 has threaded seats for fixing a disk-shaped element centrally equipped with a threaded through hole engaged by an adjustment screw partially housed, with its actuating head, in the longitudinal central cavity of the attachment 15 and acting on a matching cap of one end of the helical spring which constitutes the resilient element 23. By acting on the adjustment screw it is therefore possible to axially move the cap and adjust the compression preload of the helical spring.

In the case of such a preferred bayonet connection, the support element 3 is of a type or shape such as to position and support the roll so that the longitudinal axis of the winding mandrel M and of the attachment 15 of the gripping means are coincident or almost so that the terminal element 11 faces and/or near the attachment 15.

Figure 15:
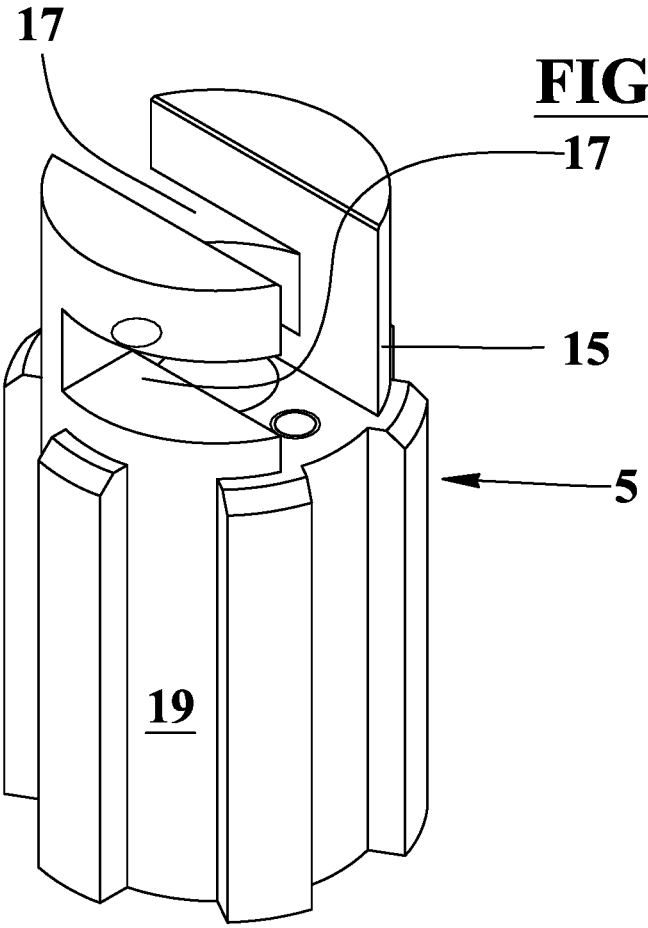
Figure 21:
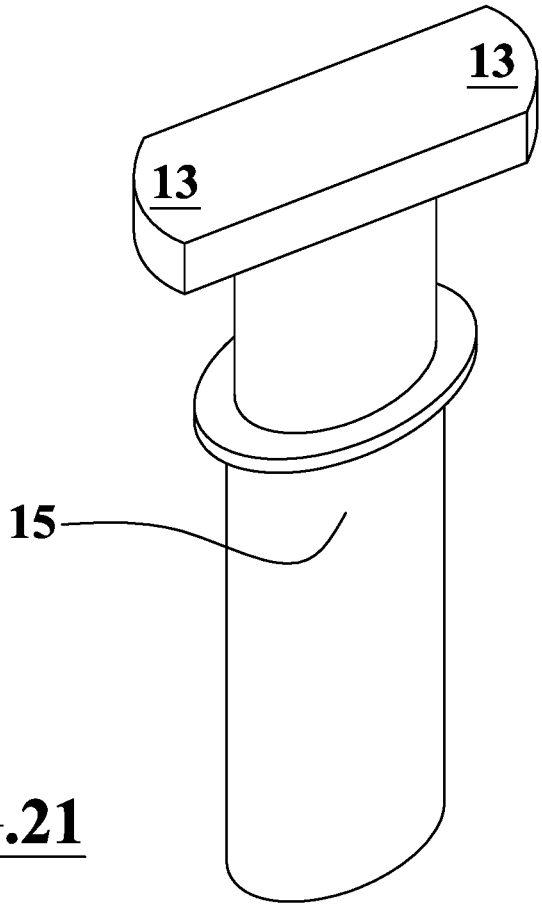
FIG. 21 shows a schematic view and not in proportion of a terminal element clearly visible in FIGS. 5-8.
Figure 17:
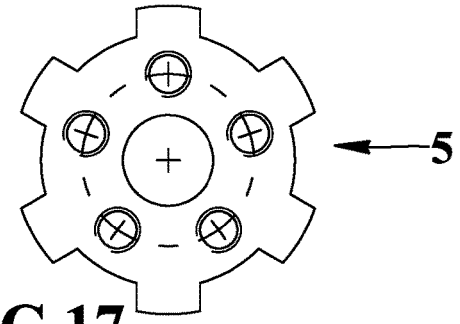
FIGS. 16-18 show respectively front and partially sectioned views, from the bottom, from the top of the attachment of FIG. 12.
Figure 19:
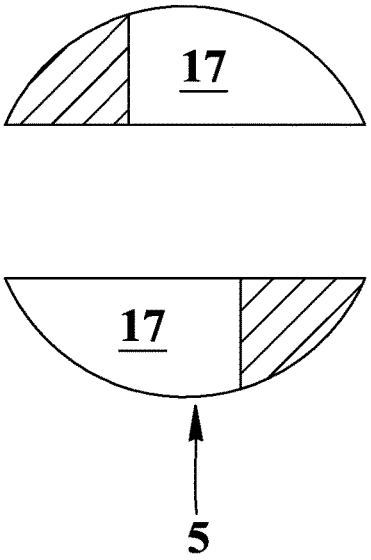
FIGS. 19 and 20 shows section views according respectively to the plans XIX-XIX and XX-XX of FIG. 16.
Figure 16:
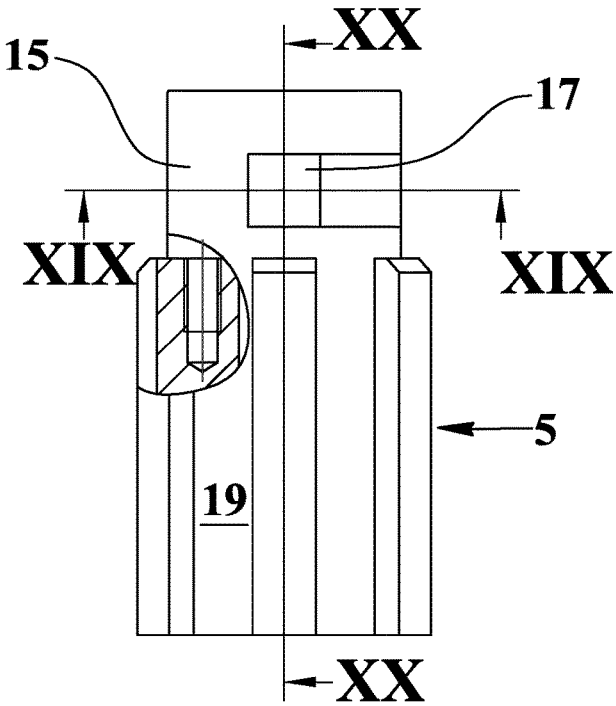
Figure 20:
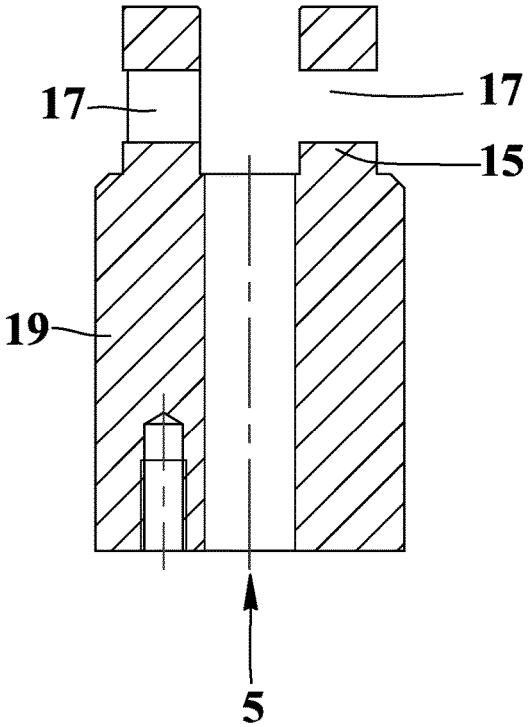
Figure 18:
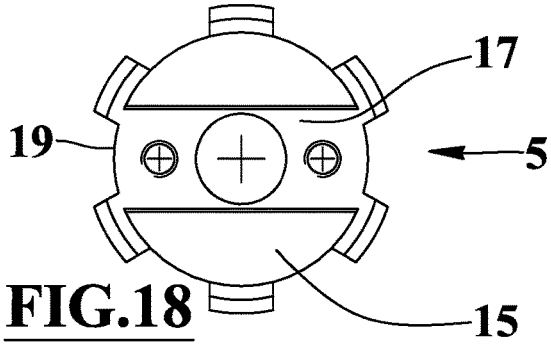

Preferably, and as showed for example in FIGS. 15 and 21, the terminal element 11 has two end opposite radial protrusions 13 which make it assume an approximately "T" shape, and the attachment 15 has two L-shaped slots 17 facing each other and with the second sections facing in the opposite direction to that of rotation during the extraction of the mandrel. This configuration allows the terminal element 11 engaged in the attachment 15 to simultaneously transmit to the mandrel the axial extraction force and the torque for rotation during extraction.

If the attachment is rotated in a direction facing the open ends of the second perpendicular sections of the "L" slots, that is in a rotation direction opposite to that simultaneous to the extraction, it is still possible to transmit a rotation torque to the mandrel but not an extraction force by applying which the disengagement of the attachment from the terminal element is obtained.

Still remaining in the case of a bayonet-type removable fixing, the end of the gripping means opposite the attachment 15 has a coupling element 19 sliding axially in a respective seat element 21 of the rotation means 7 where these coupling 19 and seat 21 elements are provided with grooves and ribs which prevent the rotation of one in respect to the other but allow the transmission of axial rotation torques.

For example, the coupling element 19 of the gripping means 5 can consist of a grooved mandrel segment sliding axially in a complementary grooved cavity which constitutes the respective seat element 21.

The rotation means 7 is provided with a resilient element 23, for example a compressed helical spring made of harmonic steel, assigned to elastically push the gripping means 5 in the direction parallel and opposite to the direction of stripping of the winding mandrel M.

The device 1 further comprises a stop means 25 assigned to match with the second end S of the winding mandrel M to counteract the strength of the resilient element 23 and assigned to prevent a translation of the winding mandrel M in the opposite direction to the gripping means 5.

Such stop means 25 can consist, for example, of a plate fixed, perpendicular to the winding mandrel, to a frame or fixed body of the support element 3 for the roll.

The coupling of the attachment with the terminal element of the mandrel of the roll supported and positioned by the support element 3 provides that the translation means 9 moves the gripping means 5 to the coupling position with the inlet of the radial protrusions 13 into the slots or, more probably with the matching of the terminal element 11 against the attachment which is then pushed towards the inside of the gripping means 5, depending on the mutual angular position of attachment and terminal element there is the first or second possibility. A rotation, preferably slow, of the gripping means 5 and of the attachment operated by the rotation means 7 ensures the correct attachment orientation with respect to the terminal element in the second case mentioned above too and the radial protrusions insertion into the slots.

The subsequent rotation in the direction of rotation during the stripping completes the coupling.

The translation means 9 comprises a carriage element 29 supporting at least the gripping means 5 and the rotation means 7.

In particular, the rotation means 7 has a body or stator rigidly fixed to the carriage element 29 and the portion of the gripping means 5 equipped with the sliding seat element 21 for the coupling element 19 is connected to the rotor or rotating mandrel of the rotation means 7 and is fixed, so as to allow its free axial rotation, to the carriage element 29.

The carriage element 29 is slidable along guides 31 parallel to the longitudinal axis of the rotation means and of the winding mandrel M of the formed roll L supported by the support element 3.

Such carriage element 29 is translated along the guides 31 by a linear actuator with parallel action to said guides, where said linear actuator is of the chain or annular belt type engaged between two pulleys where at least one of which is driven by a motor or geared motor or of nut engaged to a threaded mandrel driven in axial rotation by a motor or geared motor, or pinion type driven in axial rotation by a motor or geared motor and geared to a rack.

The length of the guides 31 and the stroke of the carriage element 29 is approximately equal to or greater than the overall length of the winding mandrel M to allow its complete stripping and deposition on a conveyor which makes the mandrel available for another winding cycle.

The device 1 comprises a control means 32 of a programmable type and equipped with inlets for analog or digital signals provided by at least one among: presence sensor 34 of the roll L on the support element 3, position sensor 36 of the first end F of the winding mandrel M, longitudinal position sensor 38 of the carriage element 29 along the guides 31, rotation sensor 40 of the rotation means 7, detectors 42 of the power absorbed by the motor of the rotation means 7 and/or of the carriage element 29; the control means is also equipped with at least one control door for operating the motors of the rotation means 7 and/or of the carriage element 29; said control means is programmed to operate the rotation means 7 and the carriage element 29 to extract the winding mandrel M from the formed roll L in accordance with said method.

A simple variant of the device, which allows to carry out said alternative orientation phase of the angular position of the winding mandrel of the roll upstream of the device so as to align the "T" terminal element of the mandrel to the opening of the internal cavity of the concave attachment can include, for example, means for orienting the winding mandrel angular position with respect to the corresponding longitudinal mandrel and means for detecting and controlling such angular orientation which is thus arranged upstream of the device. Another variant includes two motorized rollers assigned to support the roll and make it rotate slowly while a proximity sensor suitably positioned near the terminal element that is the end of the winding mandrel detects the right angular position of the terminal element protrusions. Once the phase is found, that is the alignment of the protrusions with the opening of the bayonet attachment cavity is reached, the translation and subsequent rotation of the attachment complete the latter's engagement to the terminal element of the winding mandrel. Another variant may be to put the roll in contact, which is located in the cradle of the transport device before the one aligned with the extraction device, with a motorized roller so that it always rotates slowly until a sensor detects the right position of the facet.

A further variant provides to equip the device with at least one angular position sensor placed near the gripping means and directed towards the end of the mandril-mandrel to detect the angular orientation of the radial protrusions of such end and to operate the gripping means rotation to put it in phase with the protrusion of the end before their mutual engagement and coupling.

Figure 22:
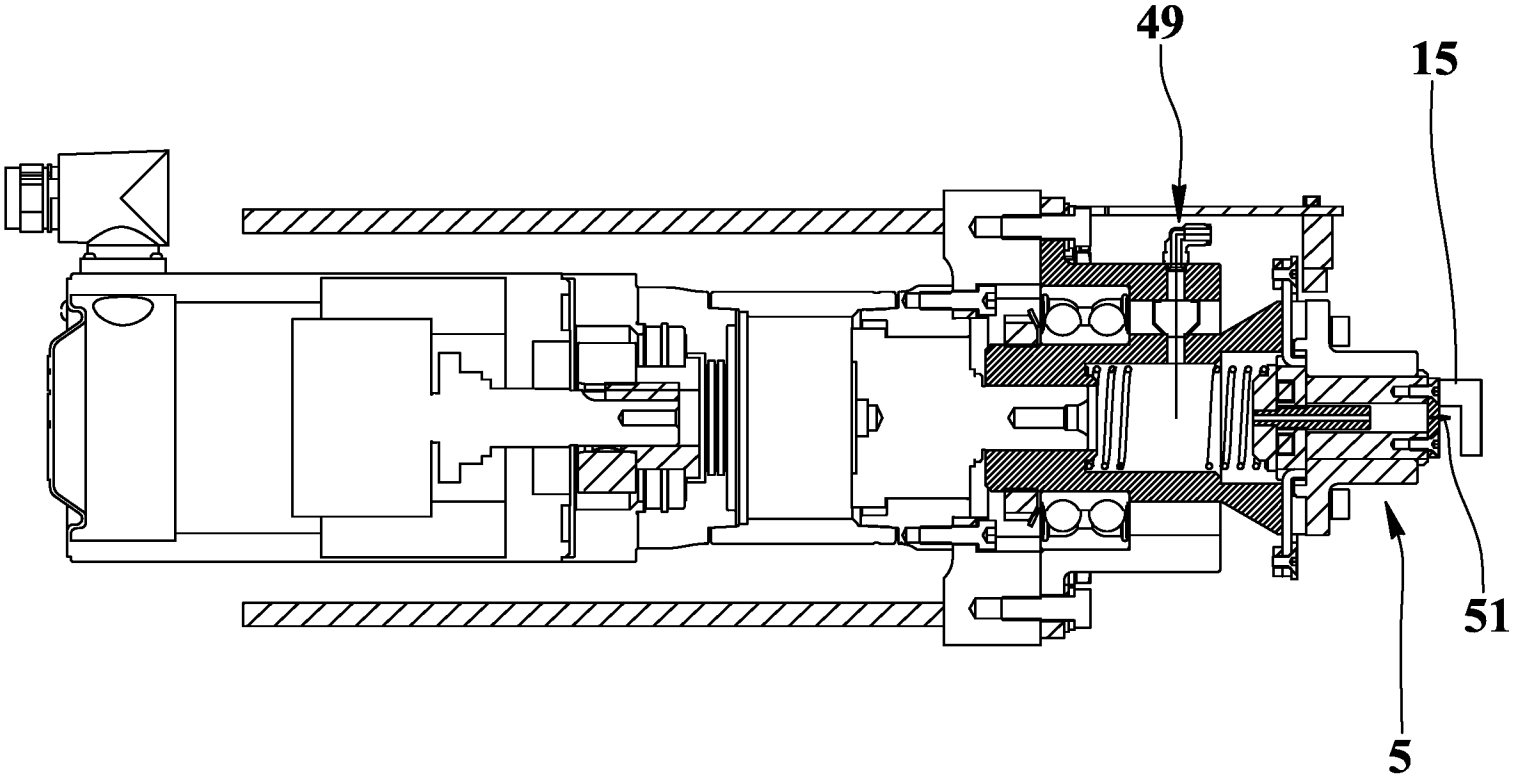
FIG. 22 shows a sectioned view of a device comprising a dispenser and a pressurized air feeder associated with the left element of FIG. 7 and assigned to feed with air an internal cavity and a plurality of through holes of a winding mandrel, not shown, during its stripping.

With reference to FIG. 22, the invention optionally provides to equip a mandrel extraction device, a device of known type or of the described above type, with elements for creating a flow or a bearing of gas or air between the mandrel and the respective roll to facilitate the extraction of the mandrel.

The device, in order to facilitate the extraction of a winding mandrel from a roll formed by winding around such winding mandrel, having two ends, first and second protruding from such formed roll, can be equipped with at least:

- a support element assigned to support the formed roll;
- a gripping means 5 assigned to be removably connected to the first end of the winding mandrel of the formed roll supported by the support element;
- a motorized translation means connected at least to the gripping means 5 to translate it parallel to said longitudinal axis of the winding mandrel of the formed roll supported by the support element;
- a gas or pressurized air supply means 49.

The winding mandrel is hollow and is equipped with a plurality of through holes that cross its wall, placing the internal cavity in communication with the outside. The second end of the mandrel is occluded and the first end has an inlet in communication with said cavity and assigned, to connect, in flow communication, with a dispenser 51 connected to said gas supply means 49 for blowing gas or air through said holes between the external surface of the mandrel and the surface of the central coil of the formed roll immediately before and during the mandrel extraction stroke or at least during the initial phase of such stroke operated by a translation means to which the gripping means 5 is fixed.

In particular, the first end of the mandrel can be equipped with a terminal element assigned to connect to an attachment 15 of the gripping means 5 at least immediately before and during the extraction of the mandrel, said attachment 15 is equipped with said dispenser 51 and the terminal element 11 is equipped with an inlet for sliding and sealing insertion and disconnection of such dispenser.

The dispenser 51 of the attachment can consist, for example, of a nozzle protruding in the portion of the attachment which is occupied by the terminal element when it is connected to the attachment. Such nozzle, for example of a conical tubular shape and aligned with the longitudinal axis of the attachment, is in flow communication with a sealed chamber of the gripping means 5 fed with gas or pressurized air from ducts, seals, connectors and pipes of the supply means 49.

The invention claimed is:

1. A method for stripping a winding mandrel from a roll formed by wrapping a web around said winding mandrel (M), comprising:

supporting the formed roll (L) so that an end of the respective winding mandrel (M) is adjacent to a gripping and rotating means (5, 7) for the winding mandrel (M);

connecting the gripping and rotating means (5, 7) to the end of the winding mandrel (M) and placing the winding mandrel in axial rotation;

applying an axial force to the gripping and rotating means (5, 7) and to the winding mandrel (M) using a translation means, and translating this winding mandrel in axial translation, according to the axial force, sliding and stripping said mandrel (M) off the formed roll (L), wherein the axial rotation comprises axially rotating the winding mandrel (M) in a direction of rotation opposite to the direction of winding the roll and starting such rotation before the axial translation of the winding mandrel (M) or simultaneously with the starting of such axial translation.

2. The method according to claim 1 comprising carrying out a fraction of rotation or one or more rotations of the winding mandrel (M) before starting the axial rotation in the rotation direction opposite to the winding direction of the roll and the axial translation of the winding mandrel (M).

3. The method according to claim 1 comprising carrying out a series of axial alternate rotations of the winding mandrel (M) in the two rotation directions before starting the axial rotation in the rotation direction opposite to that of the winding of the roll and of the axial translation of the winding mandrel (M).

4. The method according to claim 1, comprising blocking the roll, at least during the rotation and stripping of the winding mandrel (M).

5. A device for stripping, according to the method of claim 1, a winding mandrel from a formed roll (L) made by winding a web around such winding mandrel (M) that has two ends, first (F) and second (S) protruding from this formed roll (L); wherein said device (1) comprises:

a support element (3) assigned to support the formed roll (L);

a gripping means (5) assigned to removably connect the first end (F) of the winding mandrel (M) of the formed roll (L) supported by the support element (3);

wherein said device (1) further comprises:

a motorized rotation means (7) connected to the gripping means (5) to rotate it (5) around its own axis of rotation coinciding with the longitudinal axis of the winding mandrel (M) of the formed roll (L) supported by the support element (3);

a motorized translation means (9) connected to the rotation means (7) to translate it (7) with the winding mandrel (M) parallel to said longitudinal axis of the winding mandrel (M) of the formed roll (L) supported by the support element (3), wherein during operation of said device, the formed roll (L) is supported so that the first end of the respective winding mandrel (M) is adjacent to the gripping means and the rotation means for the winding mandrel (M);

the gripping means and the rotation means are connected to the first end of the winding mandrel (M) and the winding mandrel is placed in axial rotation; and an axial force is applied to the gripping means and the rotation means and to the winding mandrel (M) using a translation means, and the winding mandrel is translated, according to the axial force, to slide and strip the mandrel (M) off the formed roll (L).

6. The device according to claim 5 wherein said first end (F) is provided with a terminal element (11) with at least one radial protrusion (13) and a corresponding end of the gripping means (5) comprises a connection (15) with at least one slot (17) shaped like an "L" and with an open end for inserting the respective projection forming a removable, bayonet-type, fixing between the gripping means and the winding mandrel.

7. The device according to claim 6 wherein, in the case of removable bayonet fixing, the end opposite to the attachment (17) of the gripping means (5) has a coupling element (19) axially slidable in a respective seat element (21) of the rotation means (7) where these coupling elements (19) and seat elements (21) are provided with grooves and ribs which prevent the rotation of one with respect to the other; the rotation means (7) is provided with a resilient element (23) assigned to elastically push the gripping means (5) in the parallel and opposite direction of the stripping direction of the mandrel (M); the device (1) further comprises a stop means (25) assigned to match with the second end (S) of the winding mandrel (M) to counteract the strength of the resilient element (23) and assigned to prevent a translation of the winding mandrel (M) in the direction opposite to the gripping means (5).

8. The device according to claim 6 wherein the translation means (9) comprises a carriage element (29) supporting at least the gripping means (5) and the rotation means (7) fixed thereto (29) and sliding along guides (31) parallel to the longitudinal axis of the winding mandrel (M) of the formed roll (L) supported by the support element (3); this carriage element (29) is translated along the guides (31) by a linear actuator with action parallel to said guides.

9. The device according to claim 8, wherein said linear actuator is of the chain type or annular belt type engaged between two pulleys where at least one of which is driven by a motor or geared motor or it is of the nut engaged to a threaded shaft type where said shaft is driven in axial rotation by a motor or gear motor, or it is of pinion type driven in axial rotation by a motor or gear motor and engaged with a rack; where the length of the guides (31) and the stroke of the carriage element (29) due to the linear actuator is equal to or greater than the overall length of the winding mandrel (M).

10. The device according to claim 8, comprising a programmable control means (32) provided with inputs for analog or digital signals provided by at least one among: a sensor (32) for sensing presence of the roll (L) on the support element (3), a sensor (36) for sensing position of the first end (F) of the winding mandrel (M), a sensor (38) for sensing longitudinal position of the carriage element (29) along the guides (31), rotation sensor (40) of the rotation means (7), detectors (40) of the power absorbed by the motors of the rotation means (7) and/or of the carriage element (29); the control means is also provided with at least one output control signal for actuating the motors of the rotation means (7), of the carriage element (29), or of both the rotation means and the carriage element; said control means is programmed to operate the rotation means (7), the carriage element (29), or both the rotation means and the carriage element (29) to extract the winding mandrel (M) from the formed roll (L) in accordance with said method.

11. A device for facilitating the extraction of a winding mandrel from a roll formed by winding around such winding mandrel having two ends, first and second protruding from this formed roll, wherein said device comprises at least:

a support element assigned to support the formed roll (L);

a gripping means (5) assigned to removably connect to the first end of the winding mandrel of the formed roll supported by the support element;

a motorized translation means connected at least to the gripping means (5) to translate it parallel to a longitudinal axis of the winding mandrel of the formed roll supported by the support element;

wherein said device further comprises at least:

a means of supplying gas (49) or pressurized air;

wherein said winding mandrel is hollow and is provided with a plurality of through holes which pass through the wall placing its internal cavity in communication with the outside, one end of which is occluded and the other end carries an inlet in communication with said cavity and assigned, immediately before and during at least a first section of the winding mandrel extraction stroke by the translation means, to connect to a dispenser (51) connected to said gas supply means (49) for blowing gas or air through said holes between the outer surface of the mandrel and the surface of the central coil of the formed roll.

12. The device according to claim 11, wherein the first end of the winding mandrel is provided with a terminal element assigned to connect to an attachment (15) of the gripping means (5) at least immediately before and during the extraction of the winding mandrel, said attachment (15) is provided with said dispenser (51) and the terminal element (11) is provided with the inlet.

* * * * *